United States Patent [19]

Lacroix

[11] Patent Number: 4,820,191

[45] Date of Patent: Apr. 11, 1989

[54] CONNECTION DEVICE

[76] Inventor: Jacques Lacroix, 12 Allée de Pommeraie, 91570 Bievres, France

[21] Appl. No.: 117,530

[22] Filed: Nov. 6, 1987

[30] Foreign Application Priority Data

Nov. 7, 1986 [FR] France ..... 86 15553

[51] Int. Cl.[4] ..... H01R 4/24

[52] U.S. Cl. ..... 439/402; 439/417

[58] Field of Search ..... 439/389–419, 439/443, 444

[56] References Cited

U.S. PATENT DOCUMENTS

| | | | |
|---|---|---|---|
| 2,673,968 | 3/1954 | Smith | 439/417 |
| 4,344,665 | 8/1982 | Racilla et al. | 439/407 |
| 4,723,918 | 2/1988 | Lacroix | 439/417 |

FOREIGN PATENT DOCUMENTS

| | | | |
|---|---|---|---|
| 0077610 | 4/1983 | European Pat. Off. | 439/418 |
| 0509482 | 8/1953 | France | 439/418 |
| 2320643 | 3/1977 | France . | |
| WO86/03063 | 5/1986 | PCT Int'l Appl. . | |
| 0192890 | 11/1964 | Sweden | 439/418 |
| 2089587 | 6/1982 | United Kingdom | 439/418 |

*Primary Examiner*—David Pirlot

*Attorney, Agent, or Firm*—Lowe, Price, LeBlanc, Becker & Shur

[57] ABSTRACT

A connection device is provided including a housing with a chimney for inserting wires to be connected, extended inside the housing, and in which a catch is locked. A plug, having a slotted clip for gripping, pulling and stripping the wires by extrusion of their sheath between the catch and the clip, is driven into the housing. The clip is locked on the housing. The space between the clip and the catch is less than the diameter of the core of the wires.

8 Claims, 2 Drawing Sheets

CONNECTION DEVICE

BACKGROUND OF THE INVENTION

1. Field of the Invention

The present invention relates to a device for connecting together at least two conducting wires each surrounded by an insulating sheath, including a housing in which a passage is formed for inserting an end portion of the sheathed wires, means for receiving said end portions in the housing, means adapted for being inserted into the housing transversally to the sheaths, having at least two slits for gripping the sheaths of the wires and drawing them towards the inside nd the bottom of the housing and adapted for cooperating with the sheath reception means for stripping the wires longitudinally.

The device of the invention serves for connecting mechanically and electrically wires having several strands or, preferably, having a single strand.

2. Description of the Prior Art

Such connection devices are already known.

French Pat. No. 84 17192 describes a device in which a conducting clip, having slits for drawing wires between teeth fits onto an engagement catch having a wire receiving opening with a lower edge forming a conducting stripping edge, for drawing the ends of the wires towards the bottom of the housing and longitudinally stripping the wires.

This latter device was an improvement to other devices of a still earlier art. Although it was precisely designed particularly for better resisting pulling forces on the wires, it is in this connection not yet fully satisfactory.

In the case of drawing one of the wires in the direction opposite the direction of insertion into the case, the clip always has a slight tendency to be drawn upwardly, out of the housing. It may be the same for the catch. At the end of the travel of the clip in the housing, it is not certain that the wires have been gripped by the teeth of the clip and that they are locked in the slits thereof. Furthermore, since the clip is carried by a drawer or plug, which is driven into the housing to form the connection, and with the operator using pliers until he hears a click, caused by a part of the plug passing beyond an opening of the housing having a smaller section, it may happen that this click occurs before the plug is correctly driven into the housing.

The object of the present invention is to provide a connection device having a superior resistance to pulling out of the wires.

SUMMARY OF THE INVENTION

The present invention provides a wire connection device for connecting at least two wires, each of these wires being surrounded by an insulating sheath, the device comprising a housing having an opening in which a passage is formed for inserting an end portion of each of the sheathed wires, means for receiving the sheathed wire end portions within the housing, means adapted for being inserted into the housing transversely of the sheath having at least two slits for gripping the sheaths of the wires and pulling them inwardly and towards the bottom of the housing and adapted for cooperating with the sheathed wire receiving means for stripping the wires longitudinally, these means being characterized in that the means for gripping and pulling the sheaths comprises means for locking on the wire receiving means, the wire receiving means comprising means for locking to the housing, the bottom of the housing being stepped and having an abutment surface for cooperating with the gripping and pulling means carried by a plug having an end portion extending short of the gripping and pulling slits of a section larger than the opening of the housing, the plug also including a skirt having a section greater than a diameter of the opening of the housing into which the plug is to be driven, the skirt being connected to a cap by a portion having a section less than the opening diameter.

In another aspect of this invention, the reception means includes a catch with an opening and the gripping and pulling means includes a clip with locking pins adapted for cooperating with the upper edge of the opening of the catch.

Because of the presence of the means for locking the reception means and the means for gripping and pulling the sheaths, any pull exerted on one of the wires is not prejudicial to the quality of the mechanical locking of the assembly and so to the quality of the electric connection. Because of the presence of the abutment surface at the bottom of the housing, the sheaths are necessarily forced into the slits of the gripping means, which perfect the mechanical locking of the assembly. Finally, with the end portion of the plug of widened section extending over a large part of the height, it is certain that the closure click will be heard when the plug is completely driven into the housing and so the locking engaged.

In the preferred embodiment of the device of the invention, the means for receiving end portions of the sheathed wires have a reception opening with rounded lower edge, the closest to the bottom of the housing, which avoids cutting of the wires should a tractive force be exerted thereon, and the distance separating the reception means from the means for gripping and pulling the sheathed wires is less than the diameter of the core of the wires. Because of this latter characteristic, stripping of the wires is provided by extrusion of the sheath, caused by the relative translational movement of the gripping and pulling means with respect to the reception means and crushing of the sheath between the two means, which occurs over the whole active zone extending beyond the rounded lower edge of the opening in the reception means.

BRIEF DESCRIPTION OF THE DRAWINGS

The invention will be better understood from reading the following description of a preferred embodiment of the device of the invention, with reference to the accompanying drawings in which.

DESCRIPTION OF THE PREFERRED EMBODIMENT

Figure 1:
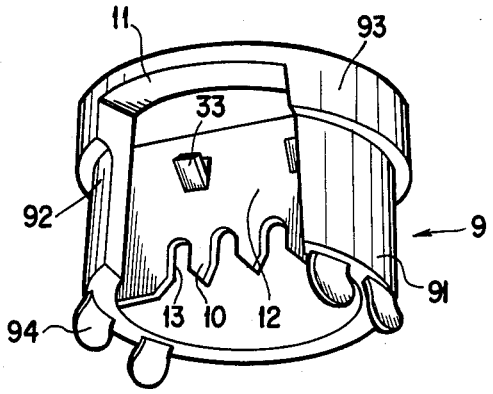
FIG. 1 shows a diagrammatic view in perspective of the drawer, or plug, of the device of the invention.
Figure 2:
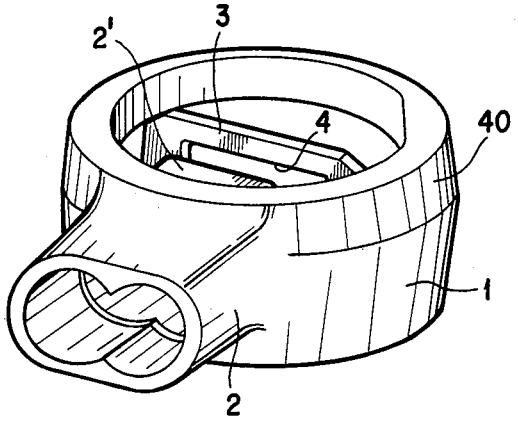
FIG. 2 shows a diagrammatic view, in a slightly different perspective, of the housing of the device of the invention.

The device shown includes a substantially cylindrical housing 1 having, on its outer surface, a lead-in chimney 2 for the wires having a substantially oblong section. Chimney 2 is extended at 2' inside the housing.

The housing is open on its upper face. The housing may, for example, be made from a molded plastic material, giving it a certain elasticity close to is opening.

Inside the housing, perpendicular to its open face and facing the opening of extension 2' of chimney 2, and close to this opening, there is provided a rigid reception catch 3, of substantially rectangular shape, and having in the extension of the chimney 2, 2', an opening 4 through which the wires pass, and whose section is substantially equal to that of chimney 2, or preferably slightly larger. The lower edge 4' of the catch, the closest to the bottom of the housing, is rounded so as to avoid possible sectioning of the wires Catch 3 is resistant and a good conductor of electricity. Catch 3 has at its lower part a base 5 of smaller width and smaller height, fitted into a groove 6 formed in the bottom of the housing so as to give it a correct position when the catch is placed in the housing.

On its face opposite that turned towards the chimney, the base 5 of catch 3 has a pin 7 for locking in the adjacent wall of groove 6, for preventing a possible rising movement. Pin 7 is obtained by stamping.

Behind groove 6 and in its adjacent part, the stepped bottom of housing 1 is raised at 20 so as to provide an abutment surface for the end portions of the wires to be connected together, parallel to chimney 2, as well as for a clip which will be discussed further on. The abutment surface 20 is extended rearwardly by a downwardly inclined surface.

The device further includes a hollow drawer, or plug, also of a generally cylindrical shape.

Figure 3:
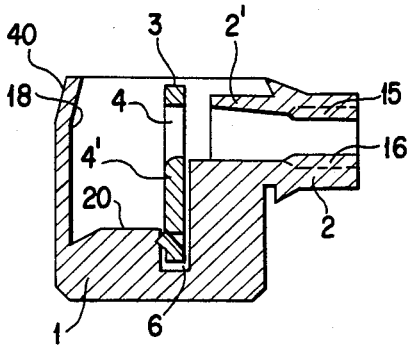
FIG. 3 shows a side view in section of the housing of FIG. 2.
Figure 4:
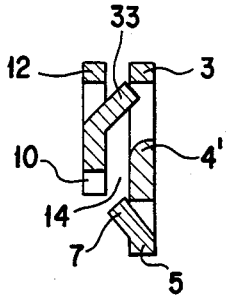
FIG. 4 shows a partial sectional view of the catch and of the clip of the device of the invention.

The plug has a skirt 91, here extending substantially over two thirds of its height, of an outer diameter slightly greater than the inner diameter of the upper opening, of the housing over the greatest part of its height. Only portion 92 of the skirt, adjacent an annular shoulder formed by the upper closed part 93 has an external diameter less than the internal diameter of the opening of the housing. When an operator fits or drives the plug into the housing, a click occurs when this part 92 crosses the opening of the housing. In this preclosure position of the device, the upper part or cap 93 covers the internal edge of the opening of the housing. Cap 93, having the general shape of a truncated cone, has a lower part of a larger section than that of the opening of the housing, and an upper part of smaller section but still larger than that of the opening of the housing. Preferably by using a pair of pliers, cap 93 is driven into the housing, for completely locking the assembly. It will be noted that the upper edge of the opening of the housing is slightly inwardly curved at 40 (FIG. 3), and that a second click, louder than the first one, is heard at the moment when the plug is completely forced into the housing. The lower end of the skirt includes lugs 94 for provisionally securing the plug and the housing together, before crimping or for storage of the assembly.

The resilient lugs 94 are curved outwardly. After lugs 94 have been forced through the opening of the housing, plug 9 is connected to the housing.

The plug is also preferably made form a molded plastic material.

Plug 9 includes a recess 11 through which the extension 2' of chimney 2 passes in the closed position.

The inside of plug 9 is shaped so as to receive a clip 12 and hold it in position. Clip 12 consists of a substantially rectangular plate whose narrowest edges have been previously bent through an angle of about 180°, each on the same side. It should be noted that in all strictness an angle greater than 90° would provide the function. The diameter of the curves and the thickness of the plate forming the clip 12 are such that this latter may, as will be seen further on, cooperate by fitting together with catch 3. Similarly, catch 3 may have its edges curved, instead of those of clip 12, which would then be flat, but this is a less satisfactory solution. Clip 12 has here, between teeth 10, three slits 13 of a width slightly less than the diameter of the core of the wires to be connected for increasing the contact surface, formed from the low part of the clip, the part inserted first into the housing. Their height is slightly greater than the diameter of the sheath of the wires. For previously assembling plug 9 and its clip 12, clip 12 is disposed in plug 9, so that its curved portions come opposite the recess 11. In the present example, clip 12 is held in position in plug 9 by a forced fit and it is positioned by grooves situated on the side walls of the plug.

Clip 12 has pins 33 for locking on catch 3, obtained by stamping, by engagement of the ends of these pins with the upper edge of the opening 4 of catch 3. Thus, any possible rising movement of the clip is avoided.

It should be noted that, in the closed position of the device, pins 33 for locking clip 12 on catch 3 and pin 7 for locking catch 3 in the groove 6 at the bottom of the housing are substantially coplanar, and in any case extend through the same gap 14 separating the clip 12 and catch 3. Furthermore, these pins 13 and 7 are directed in opposite directions from their respective feet, all this contributing to the locking quality.

The width of gap 14, between clip 12 and catch 3, is less than the diameter of the core of the sheathed wires to be connected.

Chimney 2 and its extension 2' are recessed at 15 so as to serve as a grease reserve after connection or crimping. Similarly, longitudinal ribs 16 are provided so as to separate the sheathed wires in the introduction chimney 2 and its extension 2', so that the grease surrounds each wire.

The device functions as follows.

Figure 5:
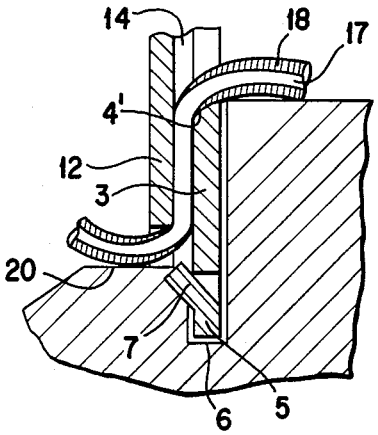
FIG. 5 shows a part of the view of FIG. 4, with a wire after it has been stripped.
Figure 6:
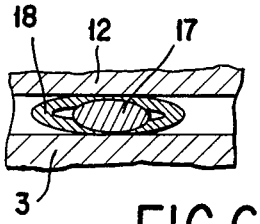
FIG. 6 shows a sectional view of the stripped wire, between the clip and the catch.

Through the introduction passsage, or chimney, 2 are inserted the unstripped ends of the sheathed conducting wires to be connected electrically and mechanically, and only one of which 17 is shown in FIG. 5.

The wires are inserted so that the end portion of each passes through the opening 4 in the reception catch 5 and abuts against the internal face 18 of the housing, opposite chimney 2.

Then plug 9 is placed against housing 1 so that their open faces coincide and are parallel.

It should be noted that catch 3 and clip 12 are placed respectively in housing 1 and plug 9 so that, when the plug penetrates into the housing, clip 12 fits onto catch 3, with its two curved portions surrounding the edges of the catch.

Plug 9 with clip 12 is forced inside housing 1, for example using a pair of universal pliers, until the slits 13 of clip 12, after each has gripped the sheath of a wire to be connected slightly short of its free end, and pulled the wire inside and towards the bottom of the housing, position the end portions of the wires in abutment against the upper bottom 20, clip 12 itself abutting agains this bottom 20 after forcing the wires to penetrate completely into slits 13.

Recess 11 makes it possible to drive plug 9 into housing 1 without the vertical position of the wires between the chimney and the catch being altered.

When the wires, gripped in slits 13, are drawn by clip 12, they are bent, portion by portion, so as to take on substantially the shape of the two surface portions adjacent the rounded edge 4' of catch 3. Simultaneously, by translation and crushing due to the width of gap 14, wires 17 are stripped over the height between edge 4' of the catch and the bottom 20 of the housing, by lateral extrusion of the insulation 18.

At the lower part, clip 12 and bottom 20 bend the wires a second time, but in the other direction, so that once the connection is made catch 3, clip 12 and bottom 20 form a zig zag trap for the wires which are thus firmly locked.

Considering the direction of movement of clip 12, the bending angles of the wires are substantially equal to the 90°, in one direction and in the other.

Considering the movement of the wires and the diameter of their core 17, stripping takes place through extrusion of sheaths 18 into the space between the clip and the catch.

Under these conditions, the core of each wire is in electric contact with clip 12 and catch 3, through the portion of the vertical inner wall adjacent opening 4. The cores of the wires are thus in electric contact with each other.

Because of the characteristics of the device which has been described, its resistance to a tractive force exerted on one of the wires, at least, is excellent. All the elements in practice contribute to locking these wires: the pins for locking the clip and the catch together, the pin for locking the catch, and so the clip and the catch, on the bottom of the housing, the teeth of the clip between which the wires are well anchored, locking the plug to the housing. This mechanical locking of the wires of course results in an electric connection of high quality. Sealing of the device is also very effective, because of its cylindrical shape.

Even if a pull should be exerted on one wire, because of the rounded edge of the passage opening of the catch, its core cannot be sectioned.

Through the extension of the insertion tunnel, the wires are inserted into the case linearly, without any risk of abutting against the catch.

With the device which has just been described, the simultaneous connection of three wires may be provided, since clip 12 here has three slits 13.

Multistrand wires or single strand wires may be connected, the device being particularly well adapted to the latter.

Providing that clip 12 has a certain elasticity and that slits 13 may grip them between their walls, even wires of different diameters may be connected together.

Of course, all the modifications of shape of the device, not affecting its essential functions, may be made without departing from the spirit and scope of the invention. In particular, the clip may be made from metal or otherwise to the extent that it does or does not play the role of conductor. It may for example be integrally formed with the plug. Similarly, the catch may possibly be partially non-conducting.

With the wires inserted into the housing through the chimney, its extension and the opening of the catch, until they abut against the opposite internal wall of the housing, the housing may advantageously be slightly recessed at this position for increasing the length of wire thus inserted.

Obviously, the invention finds its application in all kinds of industries where conductors are to be connected, such for example as the electronic and telephone industries.

What is claimed is:

1. A connection device for connecting at least two connecting sheathed wires each surrounded by an insulating sheath, comprising:

a housing having an opening in which a passage is formed inserting an end portion of each of the sheathed wires;

means for receiving said sheathed wire end portions in the housing;

means adapted for being inserted into the housing transversely to the sheaths, having at least two slits for gripping the sheaths of the wires and pulling them inwardly and towards the bottom of the housing and adapted for cooperating with the sheathed wire reception means for stripping the wires longitudinally, characterized in that said means for gripping and pulling the sheaths comprises means for locking on the reception means, the reception means include means for locking to the housing, the bottom of the housing being stepped and having an abutment surface for cooperating with the gripping and pulling means carried by a plug having an end portion extending short of the gripping and pulling slits, of a section larger than said passage opening of the housing and wherein said plug includes a skirt having a section greater than a diameter of the opening of the housing, into which the plug is to be driven, the skirt being connected to a cap by a portion having a section less than said opening diameter.

2. The device as claimed in claim I, wherein:

the means for receiving the end portions of the sheathed wires include a catch having an opening with a rounded lower edge.

3. The device as claimed in claim 1, wherein:

the distance separating the wire reception means and the wire gripping and pulling means is less than the diameter of the core of the wires.

4. The device as claimed in claim 1, wherein:

the insertion passage is extended inside the housing.

5. The device as claimed in claim 1, wherein:

the housing and the plug each have a generally cylindrical shape.

6. A connection device for connecting at least two connecting sheathed wires each surrounded by an insulating sheath, comprising a housing having an opening in which a passage is formed for inserting an end portion of each of the sheathed wires;

means for receiving said sheathed wire end portions in the housing;

means adapted for being inserted into the housing transversely to the sheaths, having at least two slits for gripping the sheaths of the wires and pulling them inwardly and towards the bottom of the housing and adapted for cooperating with the sheathed wire reception means for stripping the wires longitudinally, characterized in that said means for gripping and pulling the sheaths comprises means for locking on the reception means, the reception means include means for locking to the housing, the bottom of the housing being stepped and having an abutment surface for cooperating with the gripping and pulling means carried by a plug having an end portion extending short of the gripping and pulling slits, of a section larger than said passage opening of the housing and wherein said reception means include a catch with an opening and said gripping and pulling means include a clip with locking pins adapted for cooperating with the upper edge of the opening of the catch.

7. The device as claimed in claim 6, wherein:

the catch is provided with at least one pin means for locking in a groove of the housing.

8. The device as claimed in claim 7, wherein:

said locking pins means extends in the space between the clip and the catch.

* * * * *